US005580268A

United States Patent [19]

Miyazawa

[11] Patent Number: 5,580,268

[45] Date of Patent: Dec. 3, 1996

[54] LOCKABLE ELECTRICAL CONNECTOR

[75] Inventor: Junichi Miyazawa, Yokohama, Japan

[73] Assignee: Molex Incorporated, Lisle, Ill.

[21] Appl. No.: 415,013

[22] Filed: Mar. 31, 1995

[51] Int. Cl.[6] ..... H01R 13/627

[52] U.S. Cl. ..... 439/352; 29/868

[58] Field of Search ..... 439/352, 357, 439/358, 610; 29/868, 869

[56] References Cited

U.S. PATENT DOCUMENTS

| | | | |
|---|---|---|---|
| Re. 32,864 | 2/1989 | Ezure | 439/152 |
| 4,452,501 | 6/1984 | Gladd et al. | 439/350 |
| 4,568,135 | 2/1986 | Amp | 439/350 |
| 4,810,210 | 3/1989 | Komatsu | 439/610 |
| 4,838,808 | 6/1989 | Amp | 439/357 |
| 4,889,497 | 12/1989 | Amp | 439/76 |
| 4,900,262 | 2/1990 | Hirose | 439/354 |
| 4,915,642 | 4/1990 | Lin | 439/352 |
| 4,919,627 | 4/1990 | Cable | 439/263 |
| 4,927,374 | 5/1990 | Batty | 29/869 |
| 4,929,189 | 5/1990 | Sekiguchi | 439/352 |
| 4,954,097 | 9/1990 | Sekiguchi | 439/352 |
| 4,961,711 | 10/1990 | Amp | 439/357 |
| 4,981,447 | 1/1991 | Ichitsubo | 439/607 |
| 5,011,424 | 4/1991 | Amp | 439/352 |
| 5,021,002 | 6/1991 | Burndy | 439/352 |
| 5,074,803 | 12/1991 | Chandler et al. | 439/352 |
| 5,171,161 | 12/1992 | Kachlic | 439/610 |
| 5,383,794 | 1/1995 | Davis et al. | 439/357 |
| 5,397,246 | 3/1995 | Amp | 439/352 |

FOREIGN PATENT DOCUMENTS

| | | | |
|---|---|---|---|
| 1048230 | 7/1964 | United Kingdom | H01R 23/62 |
| 2257577 | 1/1993 | United Kingdom | 13/648 |

*Primary Examiner*—Neil Abrams
*Assistant Examiner*—Barry Matthew L. Standig
*Attorney, Agent, or Firm*—Charles S. Cohen

[57] ABSTRACT

A lockable electrical connector is provided for mating and locking with a complementary connector along a mating axis. A conductive shield is positioned substantially about a housing and a plurality of terminals. A pair of latch arms are provided generally on opposite sides of the connector and are adapted for locking engagement with appropriate latches on the complementary connector. The latch arms are flexible transversely of the mating axis from locked positions outwardly to unlocked positions. A support member is slidably mounted on the assembly for movement between a first position allowing free flexing movement of the latch arms and a second position whereat integral portions of the support member are located outside the latch arms to block flexing of the latch arms outwardly to their unlocked positions.

19 Claims, 7 Drawing Sheets

LOCKABLE ELECTRICAL CONNECTOR

FIELD OF THE INVENTION

This invention generally relates to the art of electrical connectors and, particularly, to a lockable electrical connector for mating and locking with a complementary connector.

BACKGROUND OF THE INVENTION

Mating electrical connectors typically include dielectric housings respectively mounting a plurality of terminals or contacts which, when the connectors are mated, establish an electrical interconnection. For instance, the mating connectors may be male and female connectors or plug and socket connectors for electrically connecting the terminals or contacts mounted therewithin. In some instances, the connectors have complementary interengaging locking mechanisms for locking the connectors together when mated.

Locking mechanisms for electrical connectors have caused problems in the past, because they can significantly increase the amount of forces required to mate or unmate the connectors and interengage the locking mechanisms. Consequently, connectors have been designed with locking mechanisms that are automatically engaged with ease when the connectors are mated, and separate coupling devices are movable into position after mating to make it considerably more difficult to unlock the mechanisms. However, heretofore such systems have been rather complicated and not very cost-effective because of the number of components required. This is particularly true in shielded electrical connectors which require still further shielding components.

The present invention is directed to solving the above problems by providing a lockable electrical connector which is considerably less complicated, includes fewer components and is more cost effective than lockable connectors heretofore available.

SUMMARY OF THE INVENTION

An object, therefore, of the invention is to provide a new and improved lockable electrical connector for mating and locking with a complementary connector.

In the exemplary embodiment of the invention, the connector is mateable along a mating axis and includes a conductive shield having a housing with terminals therewithin. A pair of latch arms are provided generally on opposite sides of the connector and are adapted for locking engagement with appropriate latch means on the complementary connector. The latch arms are flexible outward transversely of the mating axis from a locked position to an unlocked position. A dielectric body is mounted about at least a portion of the shield. A one-piece support member or cover is slidably mounted on the body for movement between a first position allowing free flexing movement of the latch arms and a second position whereat integral portions of the support member are located outside the latch arms to limit flexing of the latch arms outwardly to their unlocked position.

As disclosed herein, the terminals are located within a housing and the conductive shield. The body, in turn, is mounted about at least a portion of the shield. Preferably, the body is insert-molded about a portion of the shield. The latch arms are provided by forwardly projecting portions of a metal shroud positioned about the conductive shield, and the body is insert-molded about the shroud leaving the latch arms projecting freely from the body.

The invention contemplates that the latch arms be fabricated of metal material, and the body and the one-piece support member each is molded of plastic material. The material of the support member may be significantly harder than the material of the body.

Other objects, features and advantages of the invention will be apparent from the following detailed description taken in connection with the accompanying drawings.

BRIEF DESCRIPTION OF THE INVENTION

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE EMBODIMENT

Figure 1:
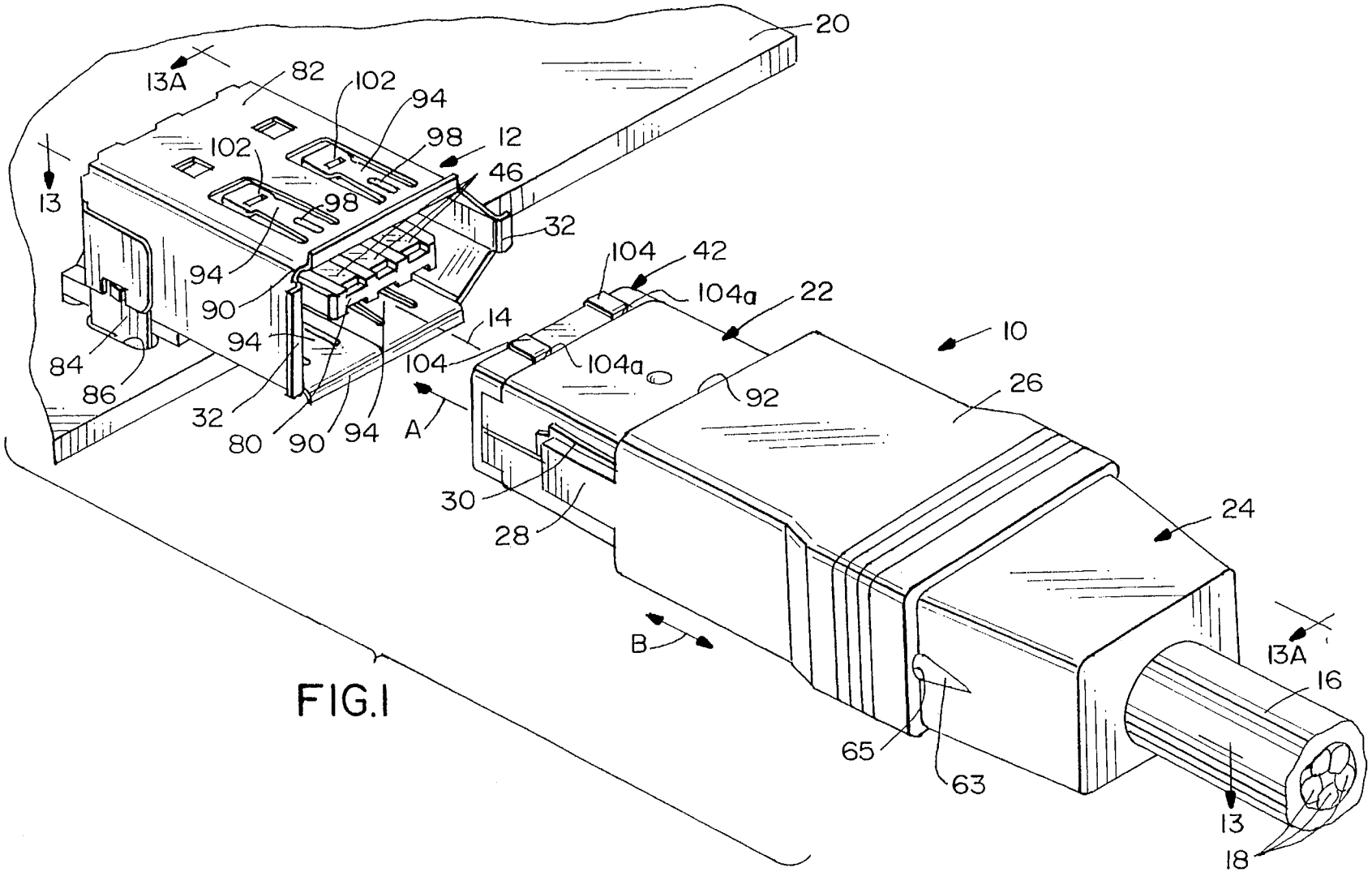
FIG. 1 is a perspective view of a lockable electrical connector embodying the concepts of the invention, along with a complementary connector mounted to a printed circuit board.

Referring to the drawings in greater detail, and first to FIG. 1, the invention is embodied in a lockable electrical connector, generally designated 10, adapted for mating and locking with a complementary connector, generally designated 12, along a mating axis 14 in the direction of arrow "A". Connector 10 is adapted for terminating an electrical cable 16 having a plurality of insulated electrical wires 18. Complementary connector 12 is adapted for mounting on a printed circuit board 20. Therefore, connectors 10 and 12 are effective to electrically interconnect the conductors of electrical wires 18 to the circuit traces on printed circuit board 20. Of course, it should be understood that the concepts of the invention are equally applicable for other types of electrical connectors.

Before proceeding with a detailed description of the internal components of lockable electrical connector 10, and still referring to FIG. 1, the connector generally includes a conductive shield, generally designated 22, of metal material and within which a housing and terminals (described hereinafter) are located. A dielectric plastic body, generally designated 24, is insert-molded about a rear end of shield 22 as will be seen hereinafter. A one-piece plastic support member or cover, generally designated 26, is mounted about the rear of shield 22 and the front of body 24 for sliding movement relative thereto generally along axis A and in the direction of double-headed arrow "B". The support member has a pair of side support arms 28 which are juxtaposed immediately outside a pair of latch arms 30 which lockingly interengage with a pair of transversely outwardly projecting latch flanges 32 on complementary connector 12, again as will be more apparent hereinafter.

Figure 2:
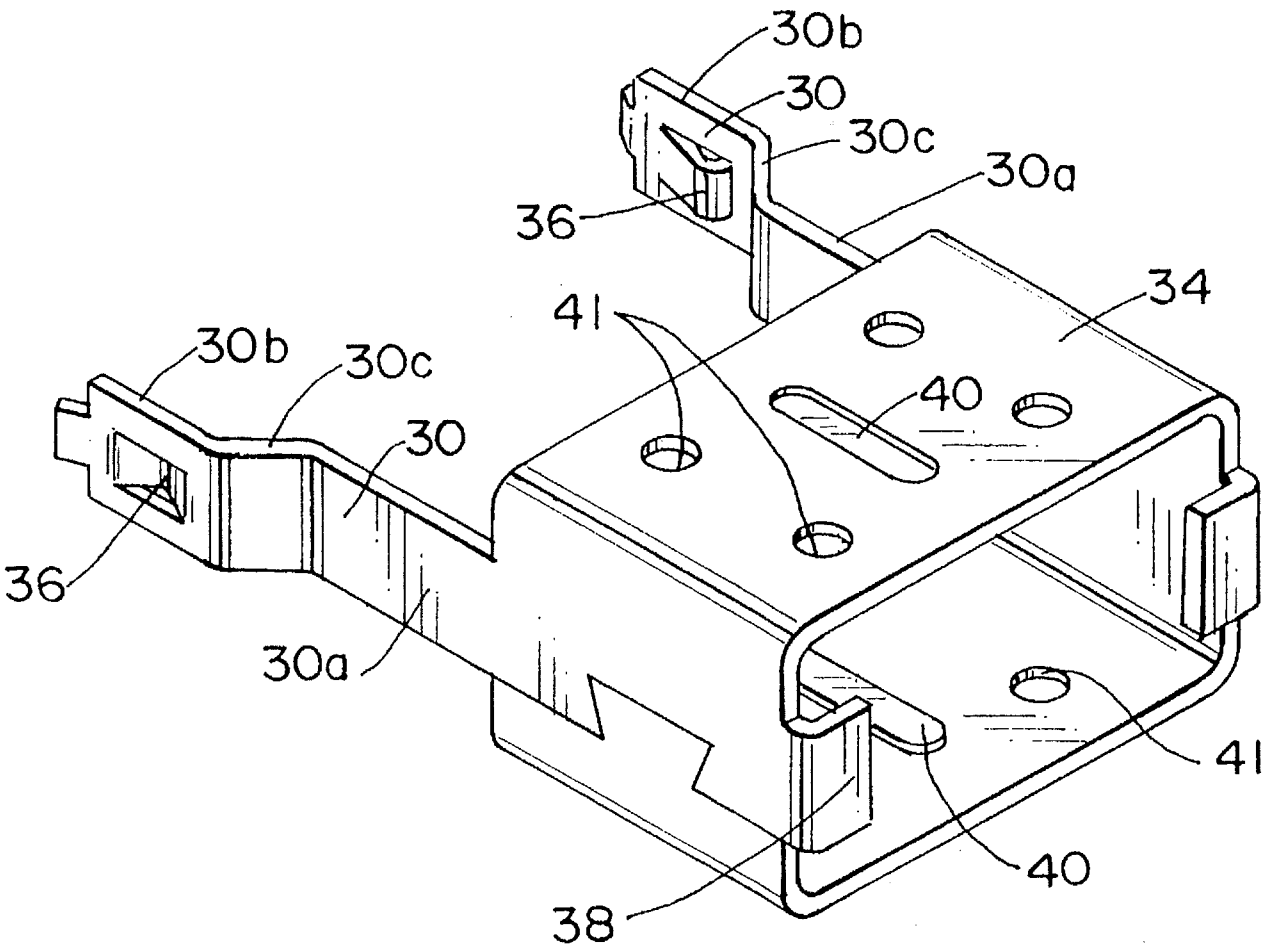
FIG. 2 is a perspective view of the shroud which includes the latch arms of the lockable connector.

FIG. 2 shows cantilevered latch arms 30 as being forwardly projecting portions of a generally rectangular shroud 34. The shroud and the latch arms are fabricated of stamped and formed conductive sheet metal material. Each latch arm includes a first section 30*a* extending generally along and from the outside of shroud 34, a free end section 30*b* having a latch boss 36 thereon and a transition section 30*c* extending between and at an angle to the first section 30*a* and the free end section 30*b* . The latch boss 36 is stamped and formed out of free end section 30*b* to project inwardly.

The latch boss 36 is generally triangular, although the exact shape depends on the specific design requirements for insertion and withdrawal forces. More specifically, by making a shallow ramp angle on the leading edge, the insertion force can be reduced while a sharper angle on the trailing edge will hold the latch more securely in place. This sharper angle will not significantly increase the force required for unmating because, as described below, the latch arms 30 are generally free to flex during unmating despite being limited during mating. Inwardly directed flanges 38 project inwardly at the rear of shroud 34 to assist in maintaining the shroud in place after assembling the connector. More specifically, during unmating, forces tending to pull the latch arms and the shroud will be resisted by flanges 38 contacting the rear of shield 22. Axially extending ribs 40 are formed or embossed in shroud 34 so as to project inwardly thereof, for purposes described hereinafter. Holes 41 are provided in the shroud to permit plastic to flow therethrough during overmolding of body 24 as described below.

Figure 3:
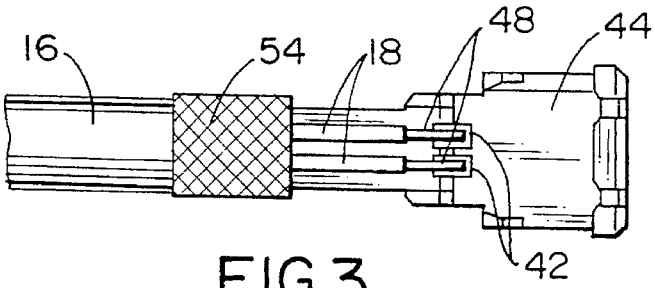
FIGS. 3 and 4 are plan and side elevational views, respectively, showing the terminals secured to an electrical cable.
Figure 4:
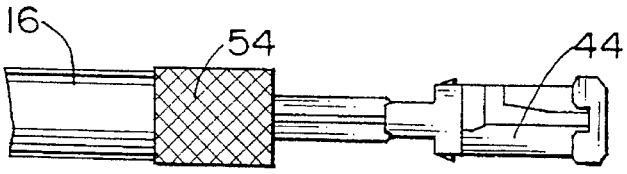

FIGS. 3 and 4 show an initial step in fabricating lockable electrical connector 10. In particular, terminals or contacts 42 are terminated, as by soldering, to conductors 48 of electrical wires 18 of electrical cable 16. The terminals are inserted into dielectric housing 44 as is known in the art. The contact portions of the terminals are not visible in FIGS. 3 and 4, but they are adapted for interconnection with a plurality of contact blades 46 (FIG. 1) of complementary connector 12.

Figure 5:
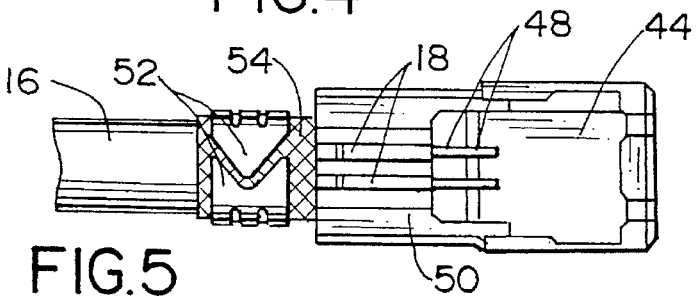
FIGS. 5 and 6 are plan and side elevational views, respectively, showing the lower shield half fixed to the assembly of FIGS. 3 and 4.
Figure 6:
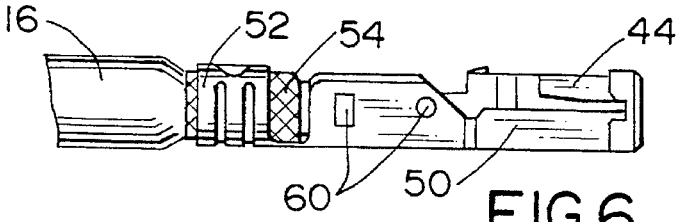

Conductive shield 22 (FIG. 1) is configured to be positioned about a substantial portion of housing 44 (FIGS. 3 and 4). More particularly, the conductive shield is a twopart shield and includes a lower half 50 shown in FIGS. 5 and 6 with housing 44 assembled therewithin. The lower half of the shield is stamped and formed of conductive sheet metal material and includes a pair of crimp arms 52 which are shown in FIGS. 5 and 6 as having been crimped about an internal shield 54 of the cable 16, after such shield has been folded back over a portion of the cable. If desired, a crimping ferrule could be utilized as is known in the art.

Figure 7:
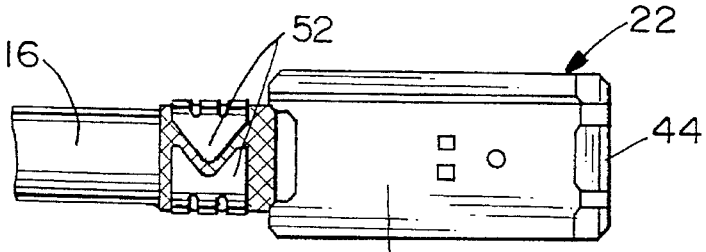
FIGS. 7 and 8 are plan and side elevational views, respectively, showing the upper shield half assembled to the lower shield half.
Figure 8:
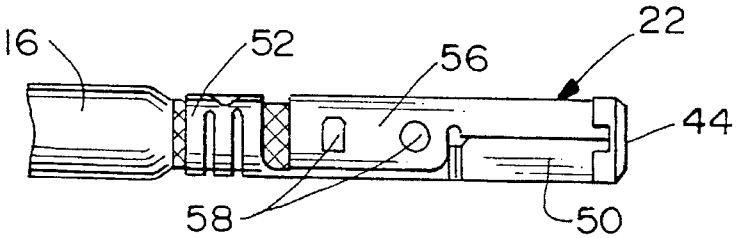

Once the housing 44 and terminals terminated to wires 18 are inserted into lower half 50 of shield 22 and is crimped to cable 16, a top half 56 of the shield is assembled to bottom half 50 as shown in FIGS. 7 and 8. Like the bottom half, top half 56 of the shield is stamped and formed of conductive sheet metal material, and complementary interengaging detents 58 (FIG. 8) on the top half snappingly interengage with detents 60 (FIG. 6) of bottom half 50 to hold the two halves of the shield in assembled condition substantially surrounding housing 44 and terminals 42 and crimped to the shield 54 of cable 16.

Figure 9:
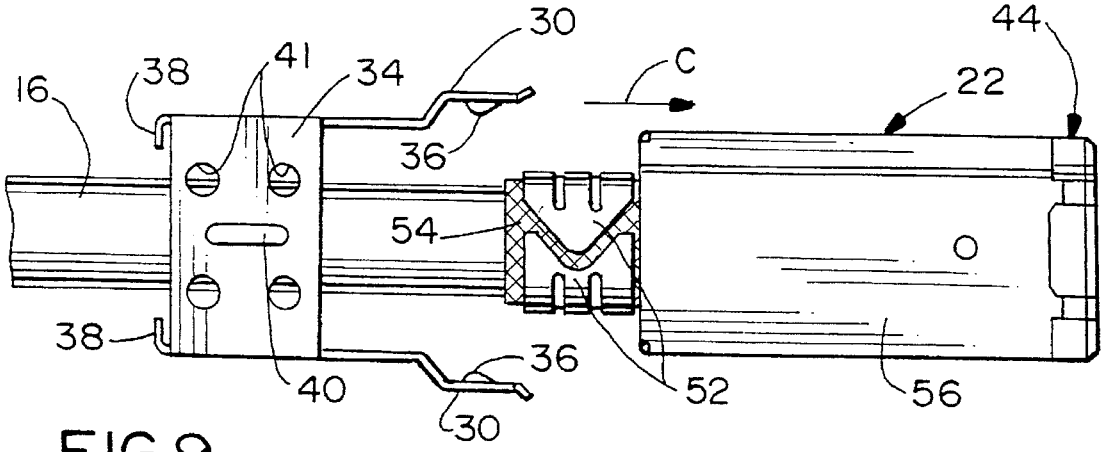
FIGS. 9 and 10 show sequential views of mounting the shroud of FIG. 2 to the assembly of FIGS. 7 and 8.
Figure 10:
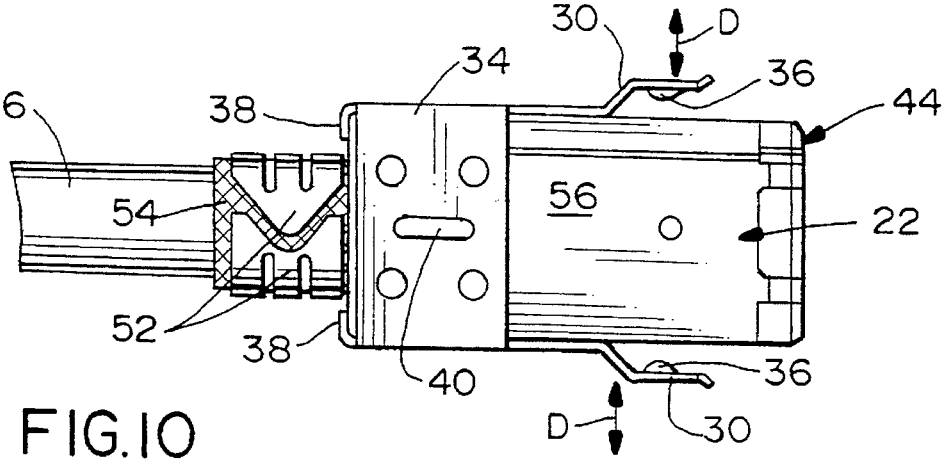

The next step in assembly of lockable electrical connector 10 is shown in FIGS. 9 and 10, wherein shroud 34 (with latch arms 30) is assembled over the rear end of shield 22 in the direction of arrow "C" (FIG. 9). When shroud 34 is fully positioned onto shield 22, rear flanges 38 of the shroud abut against the rear end of the shield. Inwardly directed, embossed ribs 40 of the shroud establish an interference fit with the shield. With both the shield and the shroud fabricated of conductive sheet metal material, the shield and the shroud are electrically commoned. Embossed ribs 40 not only provide an interference fit between the shield and the shroud, but they provide areas of increased pressure to form good positive contact between the shield and the shroud.

Figure 11:
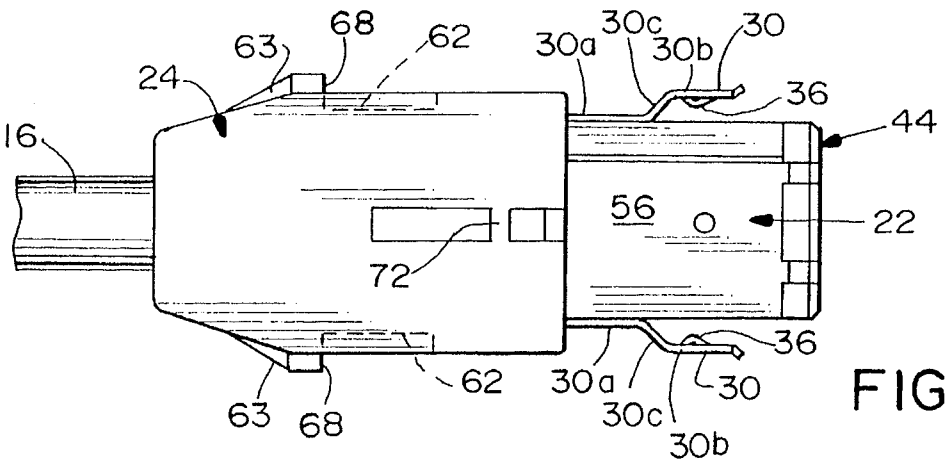
FIG. 11 is a plan view of the body insert-molded about the rear of the assembly shown in FIG. 10.

The next step in fabricating lockable electrical connector 10 is to insert-mold body 24 about shroud 34 and the rear end of shield 22 as is seen clearly in FIG. 11. It can be seen that, although the body completely surrounds the shroud and the crimped area between the shield and cable 16, latch arms 30 project forwardly of the insert-molded body and are free to flex in the direction of double-headed arrows "D" notwithstanding the fact that the body now rigidly holds the shield 22, the shroud 34 and the internal housing 44 in rigid assembled condition. The body is molded with a pair of spring-receiving recesses 62 and spring support projections 63. The spring support projections 63 combine with recesses 62 to provide a generally circular support wall 68 even though the spring 64 is exposed outside of body 24 on opposite sides thereof.

Figure 12:
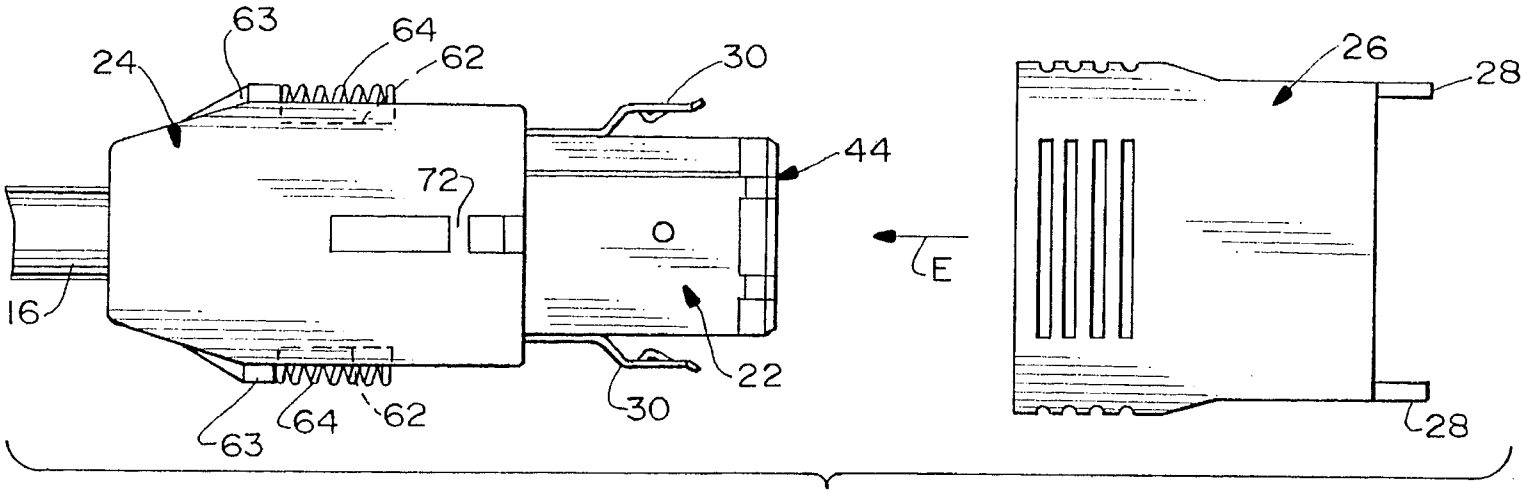
FIG. 12 is a plan view similar to that of FIG. 11, with the springs in place and the support member about to be mounted to the assembly.

The last step in assembling lockable electrical connector 10 is shown in FIG. 12. A pair of coil springs 64 are positioned against circular support wall 68 and within spring-receiving recesses 62 on opposite sides of insert-molded body 24 as is clearly seen in FIG. 12. One-piece support member or cover 26 is then slid over the subassembly described above in the direction of arrow "E" (FIG. 12). When the support member is positioned as shown in FIG. 13, it is effective to hold the coil springs within the recesses.

Figure 13:
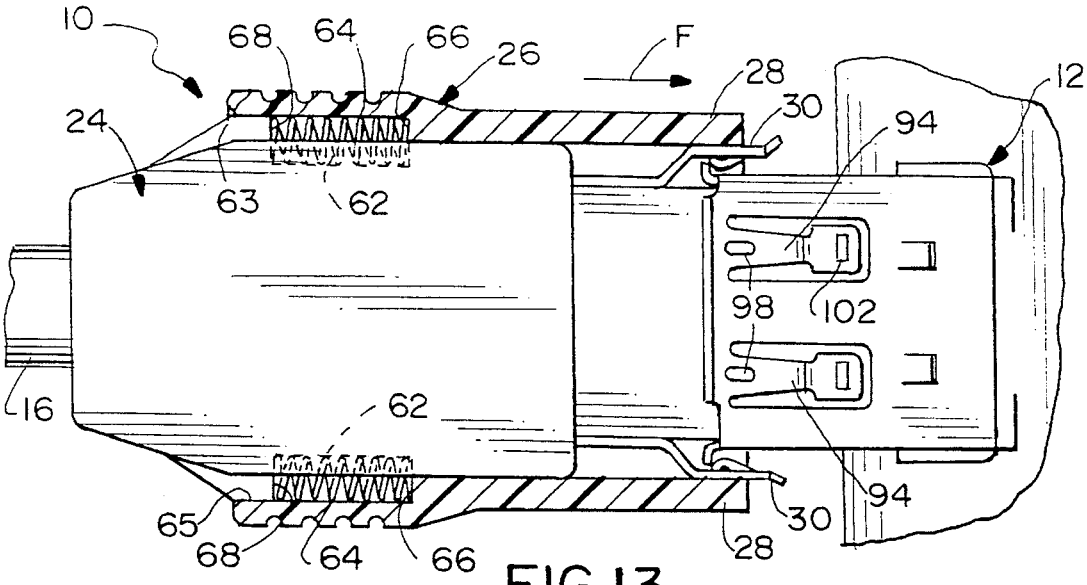
FIG. 13 is a horizontal sectional view along line 13—13 of FIG. 1 through the support member, with the member in its blocking position.

More particularly, referring specifically to FIG. 13, slidable support member 26 includes interior shoulders 66 against which forward ends of coil springs 64 abut. The rear ends of the springs abut against circular shoulders 68 in the body 24 at the rear of recesses 62. As a result, the springs bias the support member forwardly in the direction of arrow "F" (FIG. 13) such that support arms 28 which project forwardly of the support member are juxtaposed immediately on the outsides of latch arms 30. In essence, support arms 28 block much of the flexing movement of latch arms 30 transversely outwardly of the mating axis of the connector. The support member has recesses 65 on the sides adjacent the rear thereof to receive the spring support projections 63 of the body 24. The interaction between the recesses 65 and the projections 63 helps to guide the support member over the body 24.

Figure 13A:
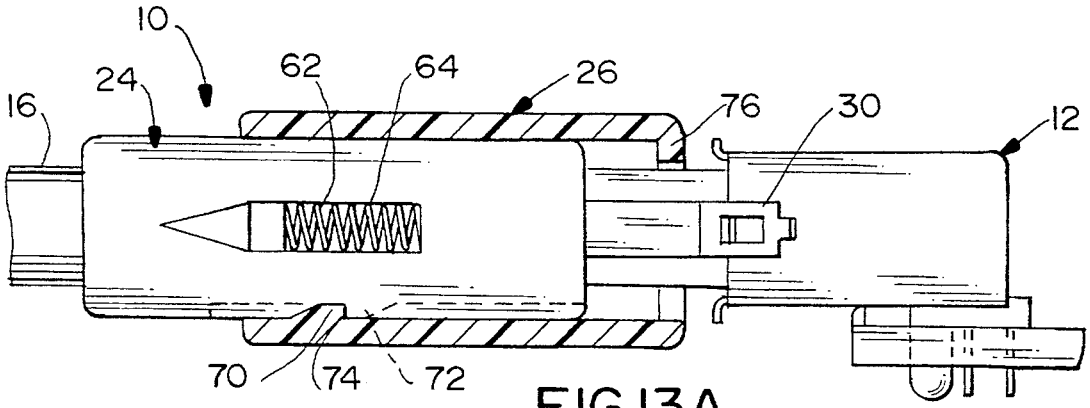
FIG. 13A is a vertical section view along line 13A—13A of FIG. 1 through the support member in the blocking position of FIG. 13.

FIG. 13A shows that slidable support member 26 has a ramped abutment boss 70 on the inside thereof and insert-molded body 24 has an oppositely facing ramped abutment boss 72 on the outside thereof. During assembly of the support member over the body, the ramped surfaces of these bosses ride over each other and then snap into interengagement at an interface 74. In the forwardly biased position of support member 26 shown in FIGS. 13 and 13A, this abutting interface defines the forward limit position of the support member as biased thereto by coil springs 64. This forward position is the locking position of the slidable support member wherein support arms 28 reduce or block outward flexing of latch arms 30 from their locked positions, as shown.

Figure 14:
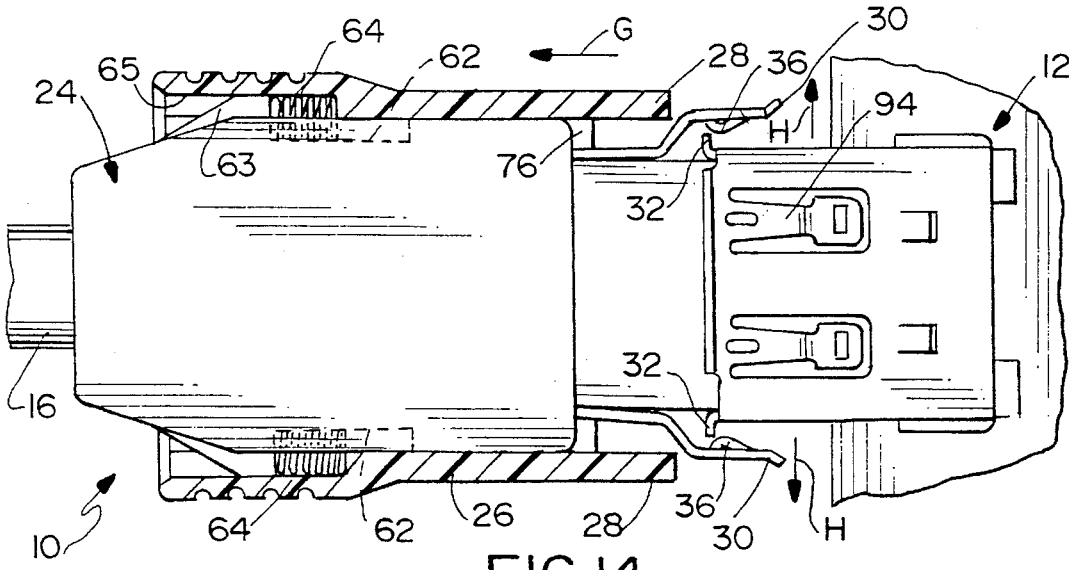
FIG. 14 is a view similar to that of FIG. 13, with the support member in its position allowing free flexing movement of the latch arms.

FIG. 14 shows support member or cover 26 having been moved rearwardly in the direction of arrow "G", compressing coil springs 64, to a position wherein flanges 76 (also see FIG. 13A) abut against the front of insert-molded body 24. This defines the rear limit position of the support member. It can be seen in FIG. 14 that support arms 28 have been moved rearwardly, clear of latch arms 30. Therefore, the latch arms are free to flex outwardly in the direction of arrows "H" and allow lockable electrical connector 10 to be unmated from complementary connector 12 with the exertion of far less unmating force than with the latch arms 30 supported as shown in FIGS. 13 and 13*a*. To this end, it can be seen that latch bosses 36 on the insides of the latch arms are ramped, oblique or otherwise triangular relative to the mating axis of the connectors to provide fairly easy mating and unmating of the connectors. 0f course, when slidable support member 26 is in its forward locking position shown in FIG. 13, support arms 28 block movement of the latch arms transversely outwardly from their locked positions.

The invention contemplates that each of insert-molded body 24 and slidable one-piece support member 26 be molded of dielectric plastic material. Although, if desired, the support member could be made from any rigid material such as metal, ceramic or the like. It is desirable to mold the body of relatively soft plastic material such as PVC since it is relatively inexpensive and easy to mold. On the other hand, support member or cover 26 preferably is molded of relatively hard or rigid material so that support arms 28 provide a rigid backing transversely outwardly of latch arms 28 to block outward flexing movement of the arms. In addition, generally, a harder material will slide more easily over a soft material such as the overmolded PVC compared to two soft materials sliding relative to each other. As such, it is contemplated that the support member could be manufactured of a glass-filled thermo plastic such as PBT, Nylon or LCP.

Figure 15:
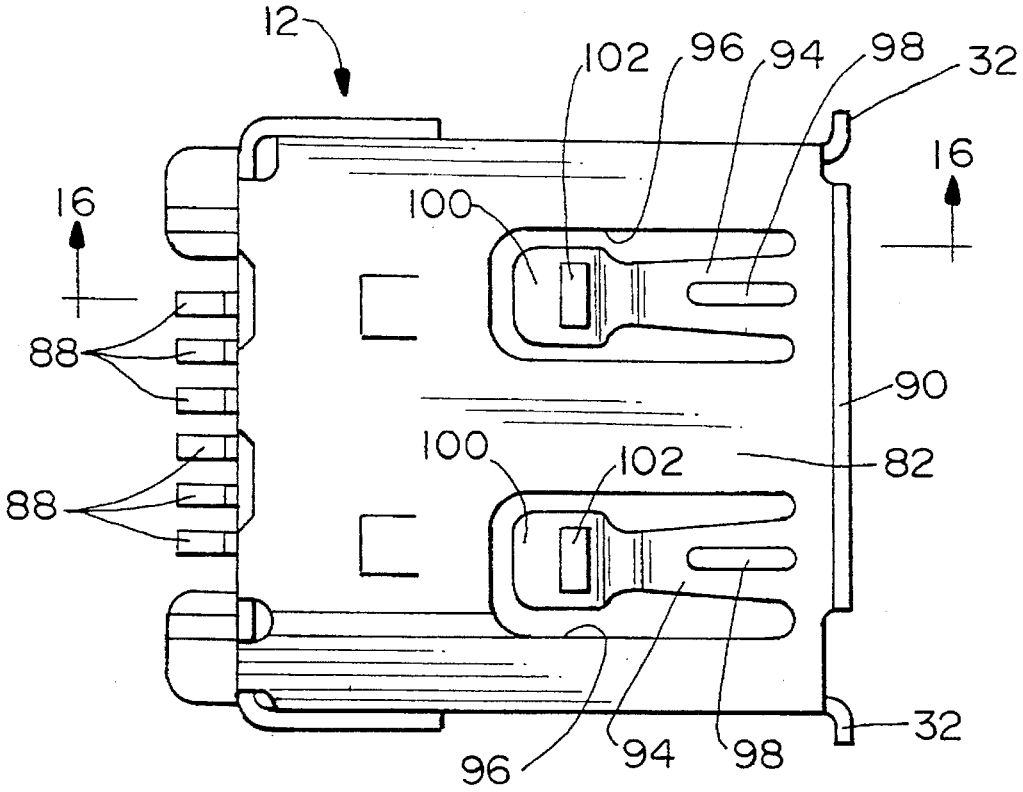
FIG. 15 is a top plan view of the complementary connector shown in FIG. 1.
Figure 16:
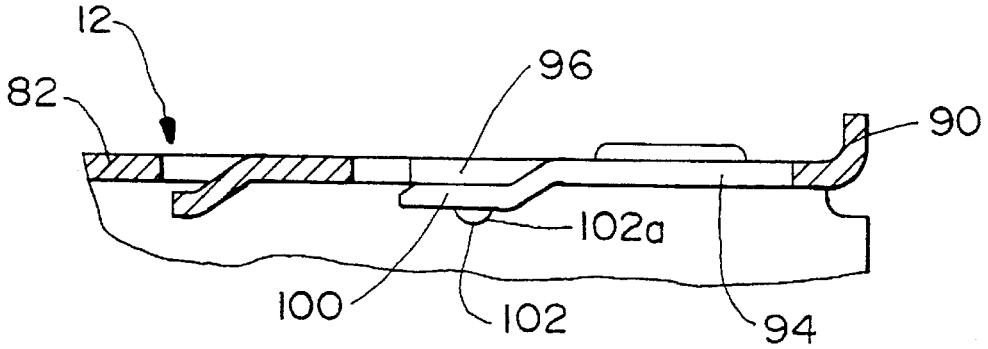
FIG. 16 is a fragmented sectional view taken generally along line 16—16 of FIG. 15.

Lastly, FIGS. 15 and 16 show the construction of an outer shield or shell of complementary connector 12. More particularly, referring to FIG. 1 in conjunction with FIGS. 15 and 16, contact blades 46 (FIG. 1) are mounted on opposite sides of a dielectric housing 80 which, in turn, is located within an outer shell or shield 82. The shell is stamped and formed of conductive sheet metal material and includes the outwardly projecting latch flanges 32 described above for interengagement with latch bosses 36 on the insides of latch arms 30. The shell has mounting legs 84 (FIG. 1) for insertion into appropriate mounting holes 86 in printed circuit board 20. Contact blades 46 have tail portions 88 (FIG. 15) for soldering to appropriate solder traces on the printed circuit board. Abutment flanges 90 project outwardly from the shell at the forward end thereof.

FIGS. 15 and 16 further show that shell 82 of complementary connector 12 has a pair of contact/latch arms 94 stamped and formed within apertures 96 in shell 82 as best seen in FIG. 15. FIG. 16 shows that contact/latch arms 94 have ribs or embossments 98 formed lengthwise thereof and extending from adjacent abutment flange 90 to provide rigidity for the arms. Distal ends 100 of the arms are offset inwardly as seen in FIG. 16, and dimples 102 are formed in the distal ends so as to project further inwardly of the shell. A pair of the contact/latch arms 94 are formed on both the top and bottom sides of shell 82. Correspondingly, a pair of outwardly offset tabs 104 (FIG. 1) project forwardly of conductive shield 22 of lockable electrical connector 10. The rear edge 104*a* of tabs 104 engage and lock against the rear edge 102*a* of dimples 102.

Now, referring back to FIGS. 13 –14 in conjunction with FIGS. 1, 15 and 16, when lockable electrical connector 10 is mated with complementary connector 12, contact/latch arms 94 of the complementary connector flex outwardly during mating and then snap back inwardly until distal ends 100 of the arms are located behind tabs 104 at the front end of shield 22 of connector 10. Dimples 102 on the inside of the arms exert a positive normal contacting force against the outside of the sheet metal shield 22. The dimples, in conjunction with the offset distal ends 100 of the arms, and further in conjunction with rigidifying ribs 98 of the arms, all combine to provide increased contacting pressure between the shield of connector 10 and the shield of connector 12 to common the shields of the connectors when mated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A lockable electrical connector for mating and locking with a complementary connector along a mating axis, comprising:

a conductive shield disposed about at least a substantial portion of a housing having terminals therein;

a pair of latch arms generally on opposite sides of the connector and adapted for locking engagement with appropriate latch means on the complementary connector, the latch arms being flexible transversely of said axis from locked positions outwardly to unlocked positions;

a dielectric body disposed about at least a portion of the conductive shield; and a one-piece support member slidably mounted on the body for movement between a first position allowing free flexing movement of the latch arms and a second position whereat integral portions of the support member are located outside the latch arms to limit flexing of the latch arms outwardly to their unlocked positions.

2. The lockable electrical connector of claim 1 wherein said housing is located within the conductive shield and the body, in turn, is mounted about at least a portion of the shield.

3. The lockable electrical connector of claim 2 wherein said body is insert-molded about said at least a portion of the shield.

4. The lockable electrical connector of claim 1 wherein said latch arms comprise forwardly projecting portions of a metal shroud positioned about the conductive shield.

5. The lockable electrical connector of claim 4 wherein said body is insert-molded about the shroud and at least a portion of the shield, leaving the latch arms projecting freely from the body.

6. The lockable electrical connector of claim 1 wherein said body and said support member each is molded of plastic material, the material of the support member being significantly harder than the material of the body.

7. The lockable electrical connector of claim 1 wherein said latch arms are fabricated of metal material and said one-piece support member is molded of plastic material.

8. A lockable electrical cable connector for mating and locking with a complementary connector along a mating axis, comprising:

a dielectric housing having terminal receiving passages therein;

a plurality of terminals adapted to be terminated to conductors of a cable;

a conductive shield disposed about at least a substantial portion of the housing;

a latch arm on the connector and adapted for locking engagement with appropriate latch means on the complementary connector, the latch arm being flexible transversely of said axis from an inner locking position outwardly to an outer unlocking position;

a dielectric body disposed about at least a portion of the conductive shield; and support means slidably mounted on the body for movement between a first position allowing free flexing movement of the latch arm and a second position located outside the latch arm to block flexing of the latch arm outwardly to its unlocking position.

9. The lockable electrical connector of claim 8 wherein said latch arm comprises a forwardly projecting portion of a metal shroud positioned about and in conductive engagement with the shield.

10. The lockable electrical connector of claim 9 wherein said body is insert-molded about the shroud and at least a portion of the shield, leaving the latch arm projecting freely from the body.

11. The lockable electrical connector of claim 8 wherein said body and said support member each is molded of plastic material, the material of the support member being significantly harder than the material of the body.

12. A lockable cable electrical connector for mating and locking with a complementary connector along a mating axis, comprising:

a dielectric housing having terminal receiving passages therein;

a plurality of terminals adapted to be terminated to conductors of a cable;

a conductive shield having said housing disposed therewithin;

a dielectric body insert-molded about at least a portion of the shield;

a latch arm on the connector and adapted for locking engagement with appropriate latch means on the complementary connector, the latch arm being flexible transversely of said axis from a locked position to an unlocked position;

a support member slidably mounted on the body for movement between a first position allowing free flexing movement of the latch arm and a second position preventing the latch arm from flexing into its unlocked position; and wherein said body and said support member each is molded of plastic material, the material of the support member being significantly harder than the material of the insert-molded body.

13. The lockable electrical connector of claim 12 wherein said latch arm comprises a forwardly projecting portion of a metal shroud positioned about the conductive shield.

14. The lockable electrical connector of claim 13 wherein said body is insert-molded about the shroud and at least a portion of the shield, leaving the latch arm projecting freely from the body.

15. The lockable electrical connector of claim 12 further comprising spring means to bias said slidable member to bias said slidable member to said second position.

16. A method of fabricating a lockable cable electrical connector for mating and locking with a complementary connector, comprising:

providing a housing having terminal receiving passages;

providing a plurality of terminals within said passages and terminated to respective ones of a plurality of conductors of a cable;

positioning a conductive shield about a substantial portion of the housing;

positioning a conductive shroud about at least a portion of the shield with a flexible latch arm projecting from the shroud and adapted for locking engagement with appropriate latch means on the complementary connector;

insert-molding a body about the shroud and at least a portion of the shield, leaving the latch arm projecting freely of the body; and slidably mounting a support member on the body for movement between a first position allowing free flexing movement of the latch arm and a second position blocking flexing of the latch arm into an unlocked position.

17. The method of claim 16, including crimping a portion of said shield to a shield of the electrical cable.

18. The method of claim 16, including providing said shroud of conductive material and positioning the shroud on the shield in conductive engagement therewith.

19. The method of claim 16, including providing said conductive shield in two-parts and assembling the shield about the terminal means by sandwiching the housing between the two parts of the shield.

* * * * *